US010702057B2

(12) United States Patent
Xi et al.

(10) Patent No.: US 10,702,057 B2
(45) Date of Patent: Jul. 7, 2020

(54) ORAL CARE IMPLEMENT AND MONOFILAMENT BRISTLE FOR USE WITH THE SAME

(71) Applicant: Colgate-Palmolive Company, New York, NY (US)

(72) Inventors: Wen Jin Xi, Shanghai (CN); Bo Zhang, Yangzhou (CN); Guang Sheng Guo, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 304 days.

(21) Appl. No.: 15/742,185

(22) PCT Filed: Jul. 7, 2015

(86) PCT No.: PCT/CN2015/083454
§ 371 (c)(1),
(2) Date: Jan. 5, 2018

(87) PCT Pub. No.: WO2017/004791
PCT Pub. Date: Jan. 12, 2017

(65) Prior Publication Data

US 2018/0192766 A1 Jul. 12, 2018

(51) Int. Cl.
*A46D 1/00* (2006.01)

(52) U.S. Cl.
CPC ..... *A46D 1/023* (2013.01); *A46D 1/0261* (2013.01); *A46D 1/0276* (2013.01); *A46B 2200/1066* (2013.01)

(58) Field of Classification Search
CPC .... A46D 1/023; A46D 1/0261; A46D 1/0276; A46B 9/04
See application file for complete search history.

(56) References Cited

U.S. PATENT DOCUMENTS 5,313,909 A 5/1994 Tseng et al.
5,770,307 A 6/1998 Rackley et al.
(Continued)

FOREIGN PATENT DOCUMENTS

CN 102791166 11/2012
DE 102006012004 9/2007
(Continued)

OTHER PUBLICATIONS

International Search Report and Written Opinion of the International Searching Authority in International Application No. PCT/CN2015/083454, dated Mar. 23, 2016.

*Primary Examiner* — Shay Karls

(57) ABSTRACT

A monofilament bristle (200) is disclosed that comprises coextruded core (210) and sheath components (220). The sheath component (220) has an outer surface (218) and surrounds a first portion (215) of the core component (210). A second portion (216) of the core component (210) protrudes from a top terminal end (203) of the sheath component (220) to form an exposed tip portion (203). In one embodiment, the exposed tip portion (203) of the core component (210) has an outer surface (217) that includes friction-enhancing features. In another embodiment, the exposed tip portion (203) is tapered and has an outer surface (217) with a first roughness and the outer surface (218) of the sheath component (220) has a second roughness, the second roughness being greater than the first roughness. In a further embodiment, the core component (210) has an outer surface (217) configured to have higher coefficient of friction than the outer surface (218) of the sheath component (220). In other embodiments, an oral care implement (100) including one or more of the monofilaments described herein is disclosed.

17 Claims, 8 Drawing Sheets

(56) References Cited

U.S. PATENT DOCUMENTS

| | | | |
|---|---|---|---|
| 5,849,410 | A | 12/1998 | Nelson et al. |
| 5,985,192 | A | 11/1999 | Weihrauch |
| 5,991,957 | A | 11/1999 | Watanabe |
| 6,021,541 | A | 2/2000 | Mori et al. |
| 6,053,734 | A | 4/2000 | Savill |
| 6,141,819 | A | 11/2000 | Driesen et al. |
| 6,161,243 | A | 12/2000 | Weihrauch |
| 6,327,736 | B1 | 12/2001 | Schaefer et al. |
| 6,349,005 | B1 | 2/2002 | Schuster et al. |
| 6,352,471 | B1 | 3/2002 | Bange et al. |
| 6,391,445 | B1 | 5/2002 | Weihrauch |
| 6,412,139 | B1 | 7/2002 | Weihrauch |
| 6,440,557 | B1 | 8/2002 | Naghibi |
| 6,678,914 | B2 | 1/2004 | Needham et al. |
| 6,772,467 | B1 | 8/2004 | Weihrauch |
| 6,871,373 | B2 | 3/2005 | Driesen et al. |
| 6,872,449 | B2 | 3/2005 | Weihrauch et al. |
| 7,014,800 | B2 | 3/2006 | Weihrauch |
| 7,503,093 | B2 | 3/2009 | Weihrauch |
| 7,644,466 | B2 | 1/2010 | Weihrauch |
| 8,297,710 | B2 | 10/2012 | Sakurai et al. |
| 8,726,448 | B2 | 5/2014 | Kato et al. |
| 8,789,228 | B2 | 7/2014 | Driesen et al. |
| 2009/0064435 | A1 | 3/2009 | Fukugaki et al. |
| 2009/0094770 | A1 | 4/2009 | Zoschke et al. |
| 2009/0255077 | A1 | 10/2009 | Mori et al. |
| 2010/0180392 | A1 | 7/2010 | Binet et al. |
| 2010/0306944 | A1 | 12/2010 | Herzog |
| 2011/0232014 | A1 | 9/2011 | Uchida et al. |
| 2011/0304194 | A1 | 12/2011 | Uchida et al. |
| 2012/0159731 | A1 | 6/2012 | Liu et al. |
| 2012/0233790 | A1 | 9/2012 | Uchida et al. |
| 2012/0233791 | A1 | 9/2012 | Uchida et al. |
| 2012/0246857 | A1 | 10/2012 | Kato et al. |
| 2013/0139340 | A1 | 6/2013 | Hiramoto et al. |
| 2015/0257525 | A1 | 9/2015 | Kang et al. |

FOREIGN PATENT DOCUMENTS

| | | |
|---|---|---|
| IN | 188794 | 11/2002 |
| IN | 1344/KOLNP/2004 | 9/2004 |
| JP | 2002-223856 | 8/2002 |
| JP | 2004-166966 | 6/2004 |
| JP | 4013553 | 11/2007 |
| JP | 2009-201794 | 9/2009 |
| JP | 2011-200351 | 10/2011 |
| JP | 2011-200352 | 10/2011 |
| JP | 5103599 | 12/2012 |
| WO | WO 1996/009781 | 4/1996 |
| WO | 1998/26117 | 6/1998 |
| WO | WO 1998/034514 | 8/1998 |
| WO | WO 2001/082742 | 11/2001 |
| WO | 2002/094058 | 11/2002 |
| WO | WO 2004/002261 | 1/2004 |
| WO | WO 2006/044964 | 4/2006 |
| WO | WO 2007/104381 | 9/2007 |
| WO | WO 2007/144038 | 12/2007 |
| WO | WO 2008/157404 | 12/2008 |
| WO | WO 2013/066070 | 5/2010 |
| WO | WO 2010/069917 | 6/2010 |
| WO | WO 2012/063565 | 5/2012 |
| WO | WO 2013/084863 | 6/2013 |
| WO | 2014/054911 | 4/2014 |

ORAL CARE IMPLEMENT AND MONOFILAMENT BRISTLE FOR USE WITH THE SAME

BACKGROUND

The present disclosure is directed to oral care implements, and more particularly to tooth cleaning elements of oral care implements.

Oral care implements such as toothbrushes include tooth cleaning elements of numerous different configurations and types of materials for cleaning the teeth. Some tooth cleaning elements such as bristles may be configured to optimize plaque and debris removal from the surfaces of the teeth, interdental regions between teeth, and along the tooth and gum line. The bristles are typically made from relatively stiff polymeric materials. Other tooth cleaning elements may be comprised of a more flexible material such as thermomaterial elastomers (TPE) for optimum polishing and stain removal action on the teeth. Improved tooth cleaning elements are desired which could combine the foregoing cleansing functions into a bristle structure and could be adapted to target specific regions of the teeth and oral cavity for cleaning, polishing, and stain removal.

BRIEF SUMMARY

Exemplary embodiments according to the present disclosure comprise oral care implements having at least one multi-component bristle extending from the head thereof. The multi-component bristle has a composite construction formed by an inner core component and an outer sheath component surrounding at least a portion of the core component. The core component may have an exposed conical tip portion in one implementation. In various embodiments, each of the core and sheath components can be formed of a different material and/or have a different type exposed surface structure or texture for optimizing cleaning and polishing/stain removal action on the teeth. The core and sheath components may be made of material in some constructions. In one implementation, the composite bristle may be designed to optimize cleansing the interdental regions between teeth.

In one embodiment, a monofilament bristle includes coextruded core and sheath components; the sheath component having an outer surface and surrounding a first portion of the core component, and a second portion of the core component protruding from the sheath component forming an exposed tip portion; the sheath component comprising a first material; the core component comprising a second material; wherein the exposed tip portion of the core component has an outer surface including friction-enhancing features. An oral care implement including the multi-component monofilament bristle includes a handle and a head coupled to the handle which supports the bristle.

In another embodiment, a monofilament bristle includes coextruded core and sheath components; the sheath component having an outer surface and surrounding a first portion of the core component, and a second portion of the core component protruding from a top terminal end of the sheath component to form an exposed tip portion; the sheath component comprising a first material; the core component comprising a second material; wherein the exposed tip portion of the core component is tapered and has an outer surface with a first roughness and the outer surface of the sheath component has a second roughness, the outer surface of the sheath component having a greater surface roughness than the outer surface of tip portion of the core component.

In another embodiment, a monofilament bristle includes coextruded core and sheath components; the sheath component having an outer surface and surrounding a first portion of the core component, the core component further having a second portion protruding from a top terminal end of the sheath component to form an exposed conical tip portion; wherein the conical tip portion of the core component has an outer surface configured to have higher coefficient of friction than the outer surface of the sheath component.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
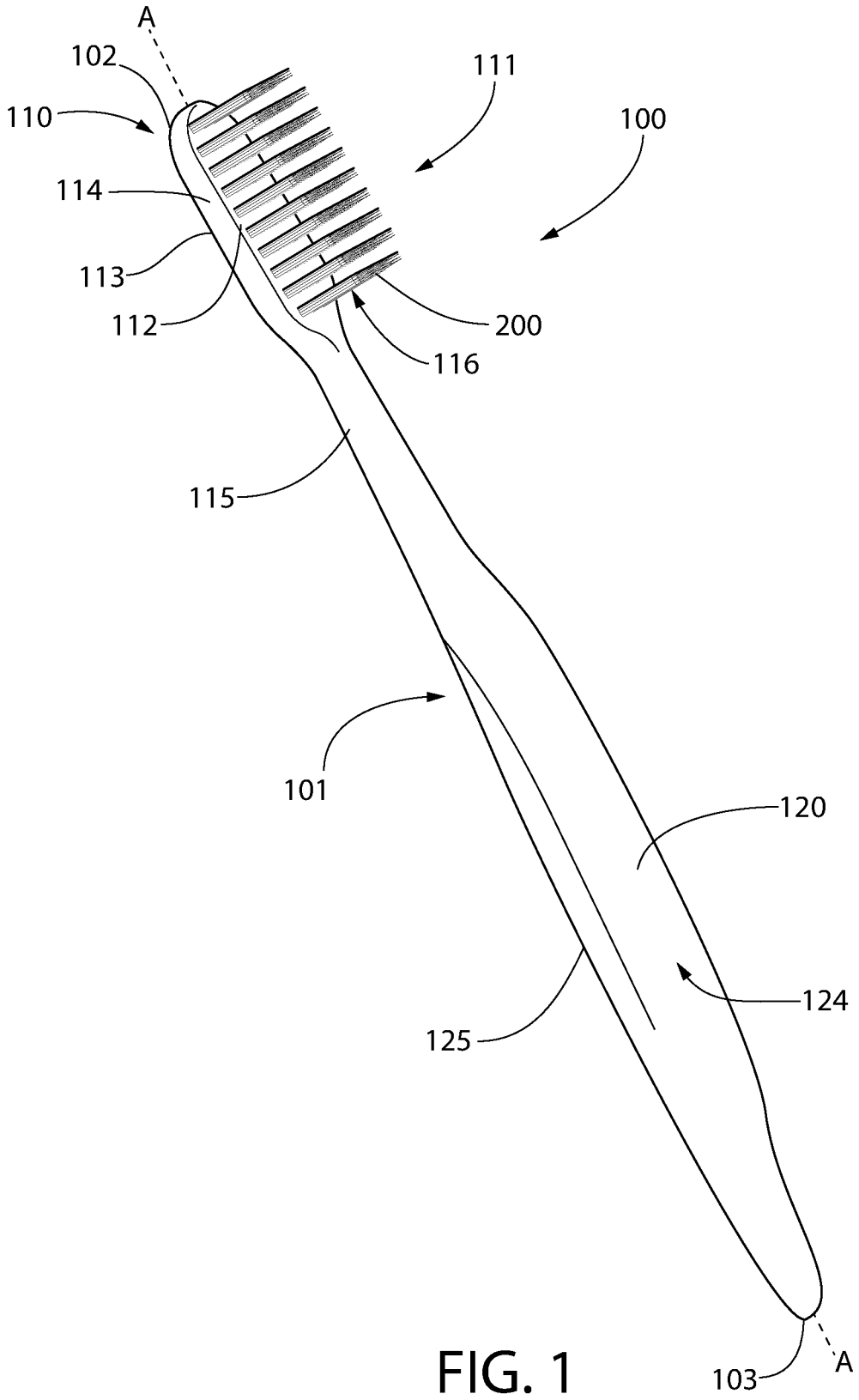
FIG. 1 is a front perspective view of an oral care implement having multi-component bristles according to an embodiment of the present disclosure.
Figure 2:
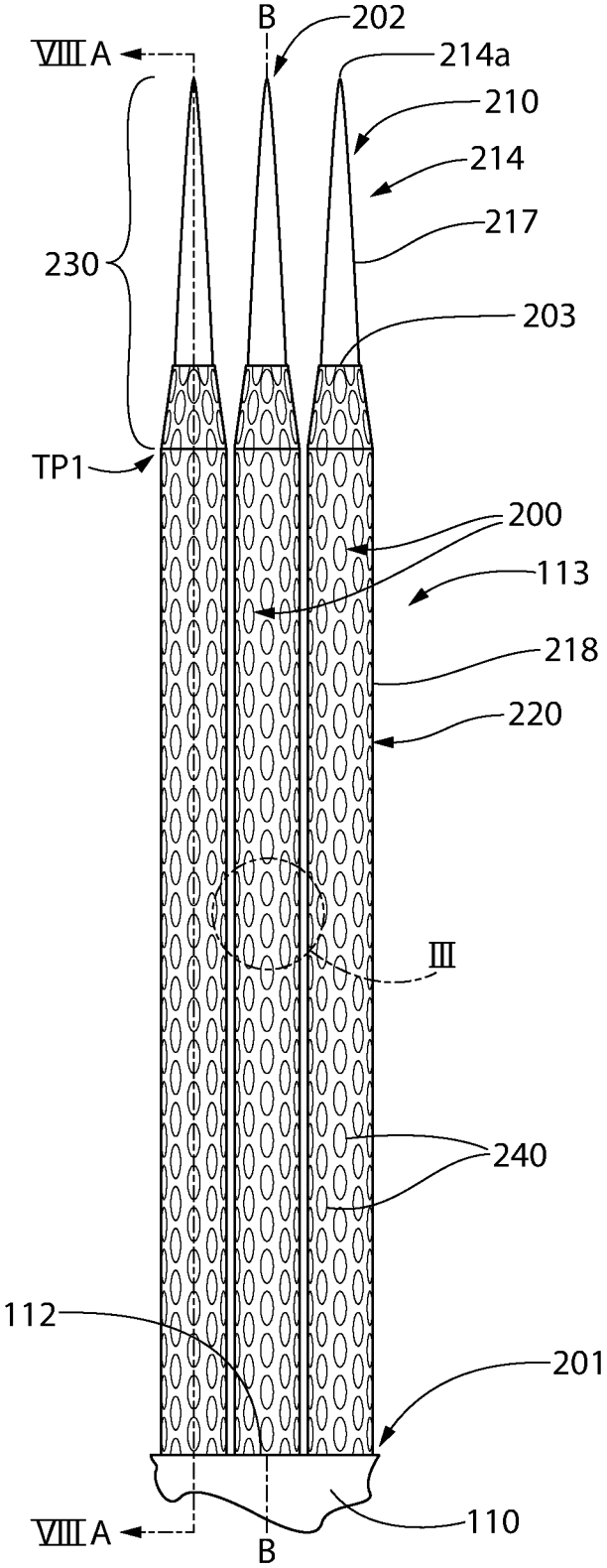
FIG. 2 is side elevation view of a portion of a bristle tuft including multi-component bristles of FIG. 1 comprising a core component and a sheath component.
Figure 3B:
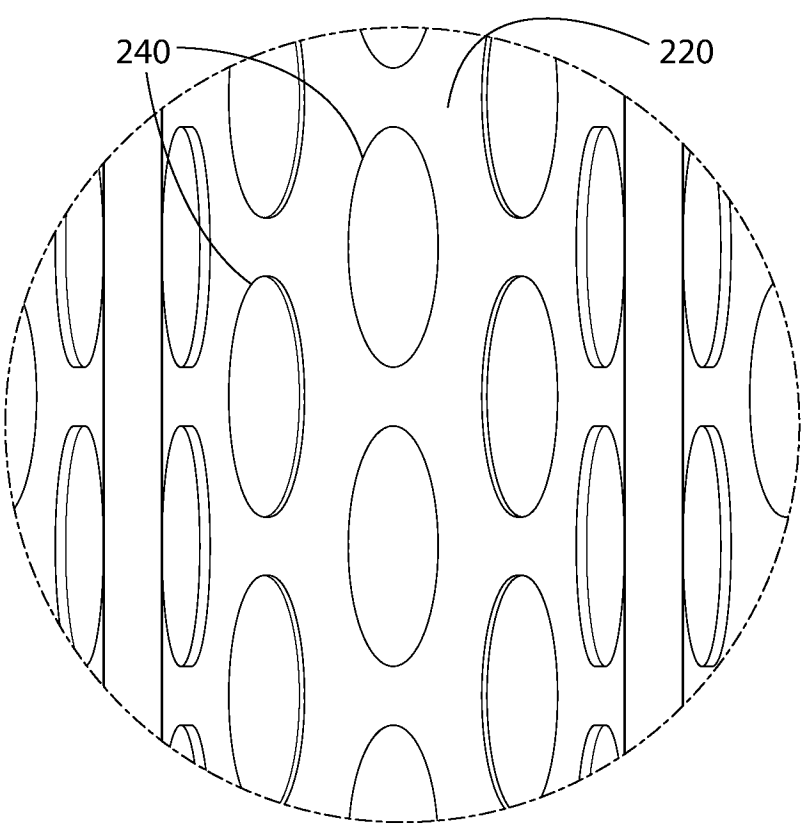
FIG. 3B is an enlarged detail similar to FIG. 3A but showing an alternative embodiment of friction-enhancing features comprising surface protuberances.
Figure 3A:
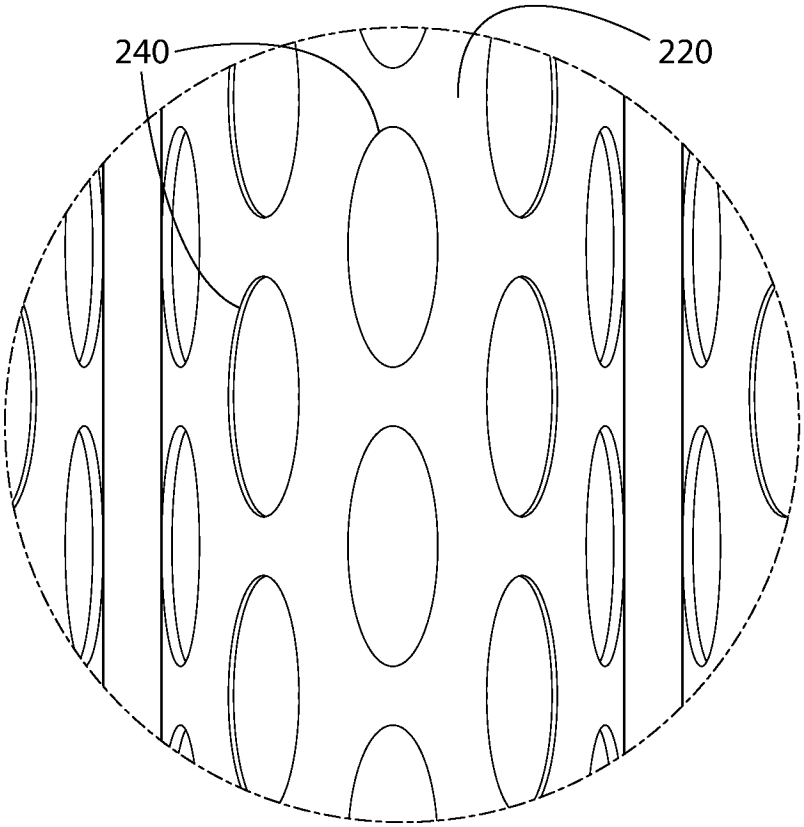
FIG. 3A is an enlarged detail from FIG. 2 showing friction-enhancing features comprising of surface recesses.
Figure 4:
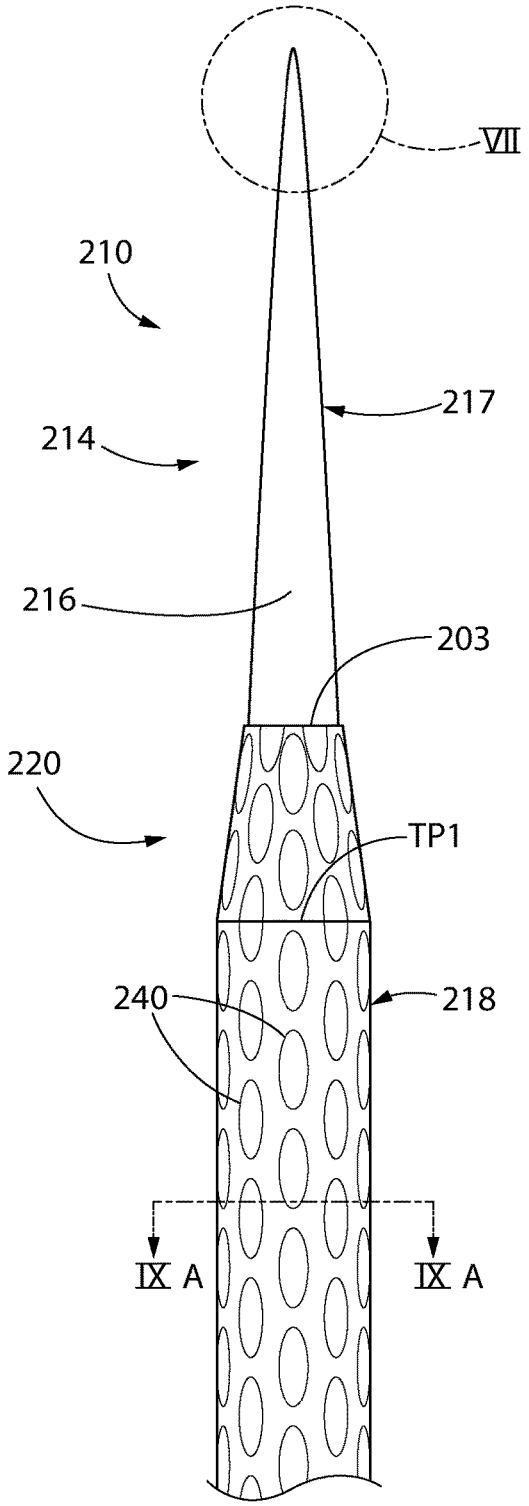
FIG. 4 is an enlarged side elevation view of a top distal portion of the multi-component bristle of FIG. 2.
Figure 5:
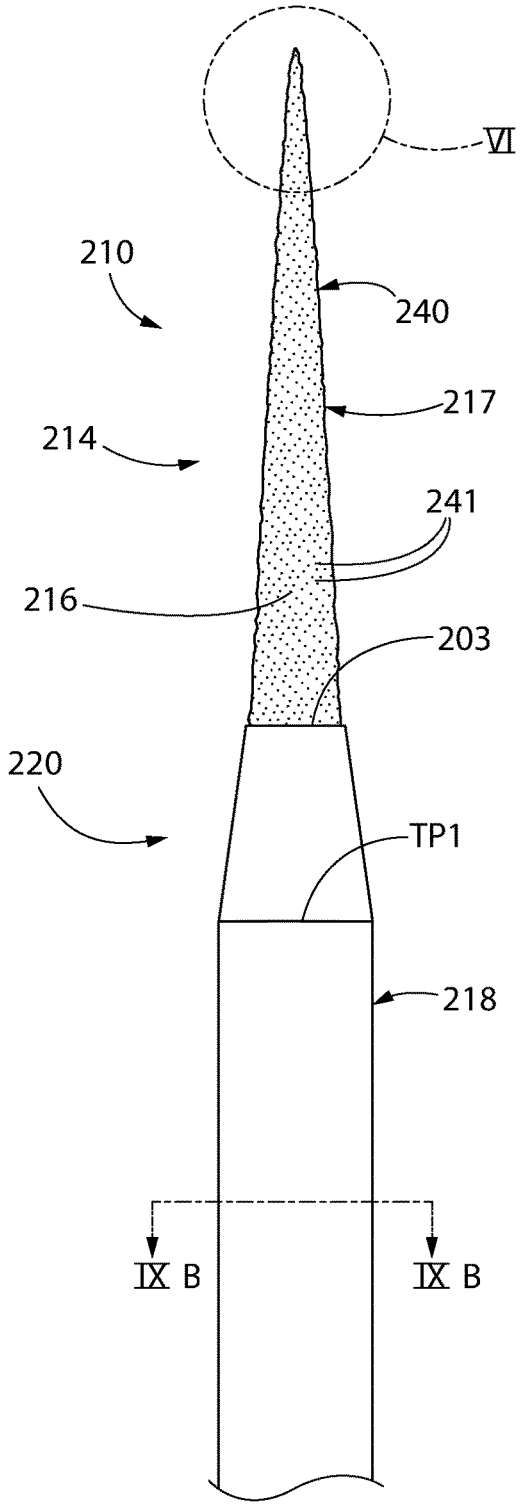
FIG. 5 is an enlarged side elevation view of a top distal portion of the multi-component bristle similar to FIG. 4 but showing an alternative construction of the multi-component bristle.
Figure 7:
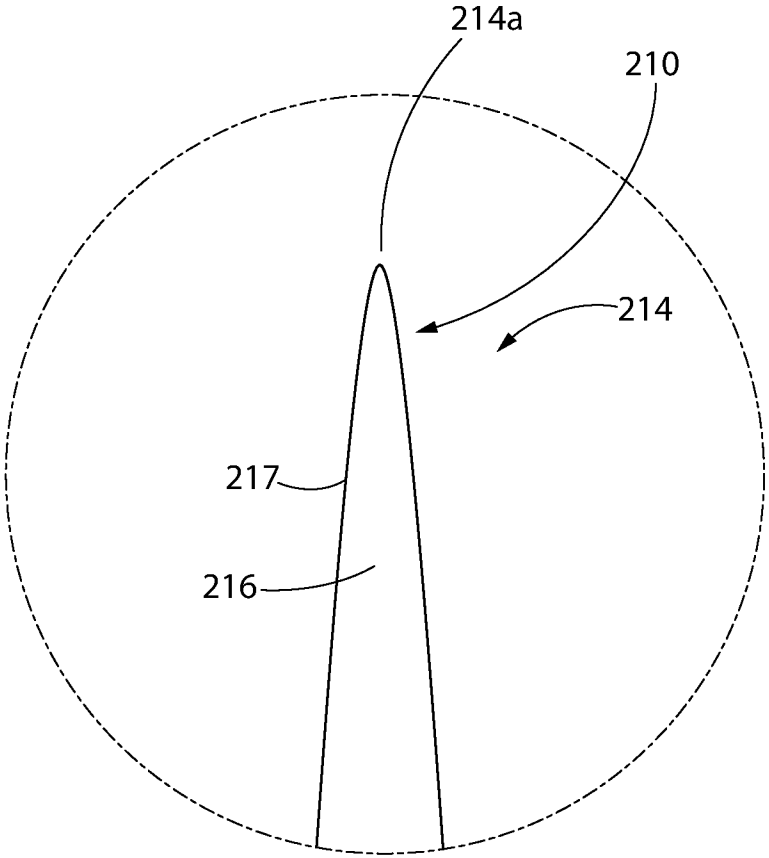
FIG. 7 is an enlarged detail of the tip portion of the multi-component bristle in FIG. 5.
Figure 6:
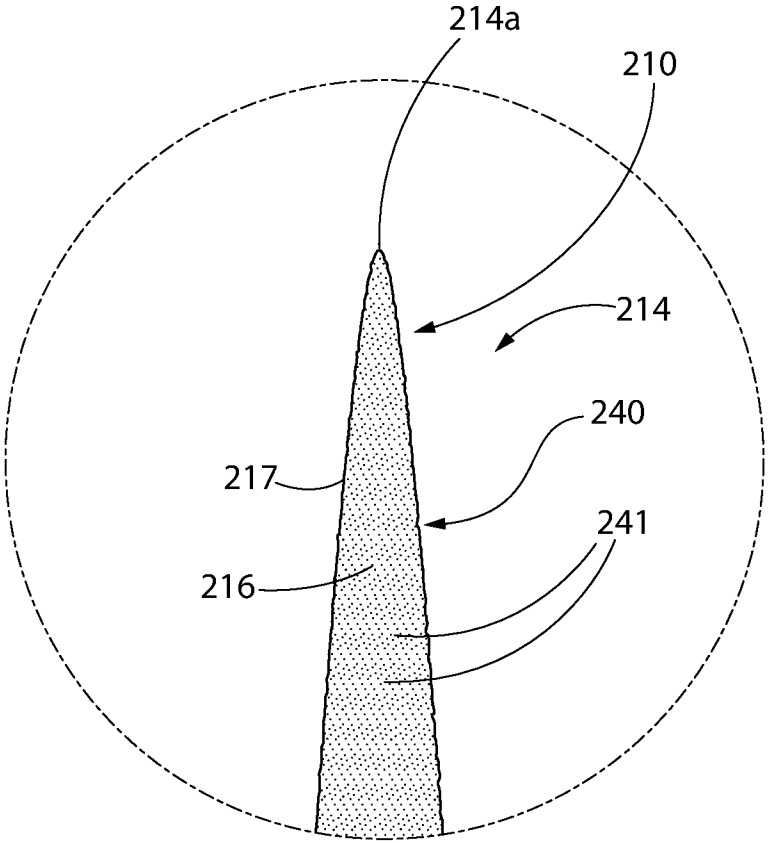
FIG. 6 is an enlarged detail of the tip portion of the multi-component bristle in FIG. 4.

All drawings are schematic and not necessarily to scale.

DETAILED DESCRIPTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth cleaning elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 103 to a distal end 102 along a longitudinal axis A-A. The oral care implement 100 generally includes an elongated body 101 comprising a head 110, a neck 115 and a handle 120. The handle 120 is an elongated structure that provides the mechanism by which the user can hold and manipulate the oral care implement 100 during use. In the exemplified embodiment, the handle 120 is generically depicted having various contours for user comfort. More specifically, in the exemplified embodiment the handle 120 is bulbous shaped and has a larger diameter in a central region than near the proximal end 103 and neck 115. A region of the handle 120 that would normally be gripped by a user's thumb has a width that is greater than a width of the neck 115. Of course, the invention is not to be so limited in all embodiments and in certain other embodiments the handle 120 can take on a wide variety of shapes, contours and configurations, none of which are limiting of the present invention unless so specified in the claims.

In the exemplified embodiment, the handle 120 is formed of a rigid material, such as for example without limitation polymers and copolymers of ethylene, propylene, butadiene, vinyl compounds and polyesters such as polyethylene terephthalate. Of course, the invention is not to be so limited in all embodiments and the handle 120 may include a resilient material, such as a thermomaterial elastomer, as a grip cover that is molded over portions of or the entirety of the handle 120 to enhance the gripability of the handle 120 during use. For example, portions of the handle 120 that are typically gripped by a user's palm during use may be overmolded with a thermomaterial elastomer or other resilient material to further increase comfort to a user.

The head 110 of the oral care implement 100 is coupled to the handle 120 and comprises a front surface 112, an opposing rear surface 113, and opposing peripheral side surfaces 114 extending therebetween. In the exemplified embodiment, the head 110 is formed integrally with the handle 120 as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

In the exemplified embodiment, the head 110 of the oral care implement 100 is provided with a plurality of tooth cleaning elements 111 extending from the front surface 112. Although in the exemplified embodiment all of the tooth cleaning elements 111 appear to be the same, the invention is not to be so limited in all embodiments. For example, in certain embodiments the tooth cleaning elements 111 include at least one bristle tuft 116 comprising at least one multi-component bristle 200 comprising a core component and a sheath component. In the illustrated embodiment, a plurality of bristle tufts 116 are disposed on front surface 112 of the toothbrush head 110. The details of various structural forms for a multi-component bristle will be described in more detail below with reference to FIGS. 2-5.

Each bristle tuft 116 is comprised of a plurality of individual composite bristles 200 arranged together into a single tuft hole (not shown) formed in the front surface 112 of the head 110. Each bristle tuft 116 may include, for example without limitation, only multi-component bristles, a combination of multi-component bristles and single-component (i.e., traditional) bristles, or only single-component bristles. In certain embodiments, the oral care implement 100 may include one or more bristle tufts that include exactly one multi-component bristle 200 and a plurality of single-component bristles or one or more bristle tufts that include only multi-component bristles. In still other embodiments, the tooth cleaning elements 111 may all be formed as bristle tufts 116 that are formed solely of multi-component bristles 200. Furthermore, in some embodiments the tooth cleaning elements 111 may include some bristle tufts that are formed solely of single-component bristles and some bristle tufts that are formed solely of multi-component bristles 200, and the single-component bristle tufts and multi-component bristle tufts may be positioned on the head 110 of the oral care implement 100 in an alternating or non-alternating fashion (i.e., alternating or non-alternating transverse rows of bristle tufts, alternating or non-alternating longitudinal rows of bristles, or even alternating or non-alternating tufts in each row).

Other than including at least one bristle tuft 116 comprising at least one multi-component bristle 200, the exact structure, pattern, orientation and material of the remainder of the tooth cleaning elements 111 is not to be limiting of the present invention unless so specified in the claims. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue cleaning elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 111 of the present invention can be connected to the head 110 in any manner known in the art. For example, staples/anchors, in-mold tufting (IMT) or anchor free tufting (AFT) could be used to mount the cleaning elements/tooth engaging elements. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In the exemplified embodiment, the head 110 of the oral care implement 100 comprises a plurality of tuft holes (not visible) formed therein. A plurality of tufts of bristles are positioned within and affixed to the head 110 within each of the tuft holes. Each of the tufts of bristles includes a plurality of bristles, which can be single strand bristles, double strand multi-component bristles, triple strand multi-component bristles, etc. or various combinations thereof. Thus, one tuft of bristles may include one double strand multi-component bristle and a plurality of single strand bristles, or alternatively only double strand multi-component bristles, or alternatively only triple strand multi-component bristles, or alternatively a combination of single strand bristles, double strand multi-component bristles and triple strand multi-component bristles. Additionally, in some embodiments a single tuft hole may be filled with an elastomeric cleaning element or any of the other types of cleaning elements noted above. As noted above, in one embodiment at least one bristle tuft 116 includes at least one multi-component bristle 200, which may be a double, triple or more strand multi-component bristle.

The details of the multi-component bristles 200 will now be discussed in more detail. Referring now to FIGS. 2-9B inclusive, each multi-component bristle 200 extends from a base end 201 attached to and/or embedded the front surface 112 of toothbrush head 110 to a free end 202 along a bristle axis B-B. The bristle axis B-B and bristles may be disposed perpendicular to the front surface 112 and longitudinal axis A-A of the toothbrush 100 in one exemplary embodiment as depicted. In other embodiments, the bristle axis B-B and bristles may be obliquely oriented and angled with respect to the front surface 112 of head 110 so that the bristles 200 are similarly disposed obliquely angled with respect to the front surface and longitudinal axis. The tooth cleaning elements 111 of toothbrush 100 may including any single or a combination of orthogonally or obliquely oriented bristle tufts 116 and multi-component bristles 200.

The multi-component bristles 200 each comprise an inner core component 210 and an outer sheath component 220 that are coextruded to form a multi-component composite structure. Stated another way, the multi-component bristle 200 comprises the coextruded core and sheath components 210, 220. Core component 210 has solid structure and sheath component 220 has a hollow tubular structure. In the exemplified embodiment, the sheath component 220 surrounds a first lower portion 215 of the core component 210 disposed proximately to front surface 112 of toothbrush head 110 and a second upper portion 216 of the core component 210 disposed distally to the front surface. The upper portion 216 protrudes upwards from the top terminal end 203 of the sheath component 220 and forms part of a tip portion 203 of the multi-component bristle 200 comprising the exposed tapered section 214 of the core component 210. The upper portion 216 of the core component 210 is therefore arranged to engage tooth surfaces whereas the lower portion 215 of the core component 210 is completely encapsulated by sheath portion 220 and does not engage the tooth surfaces when the oral care implement 100 is used. Thus, at least a portion of each of the core component 210 and the entirety of the sheath component 220 is exposed and visible from an exterior of the multi-component bristle 200.

In the exemplified embodiment, each of the core and sheath components 210, 220 originate at the base end 201 of the multi-component bristle 200 and extend upwards from surface 112 of toothbrush head 110. The core component 210 extends from the base end 201 of the multi-component bristle 200 to the free end 202 of the multi-component bristle 200. The sheath component 220 extends from the base end 201 of the multi-component bristle 200 to a top terminal end 203 of the sheath component 220 spaced vertically apart from and below the free end 202 of multi-component bristle 200 along the bristle axis B-B.

Figure 9B:
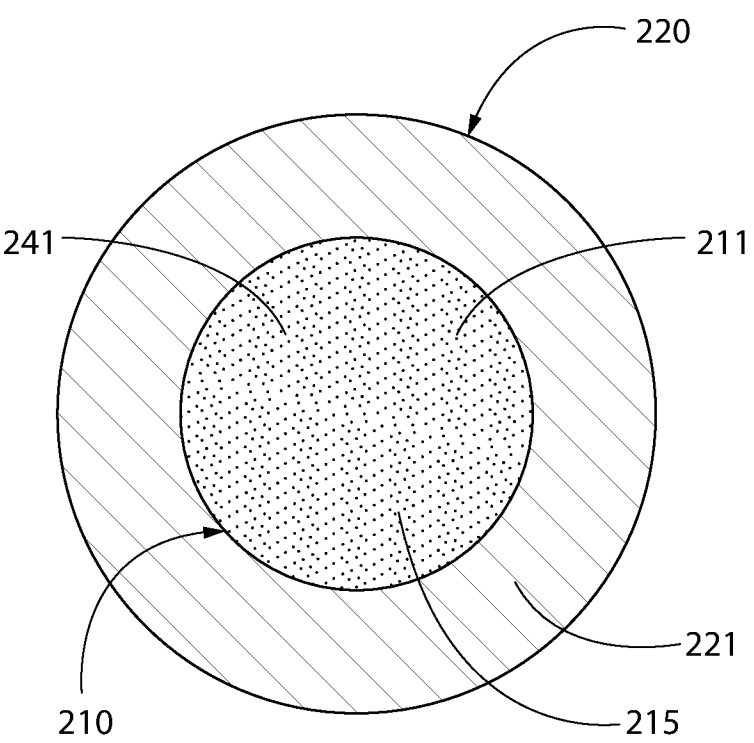
FIG. 9B is a cross sectional view taken along line IXB-IXB in FIG. 5.
Figure 9A:
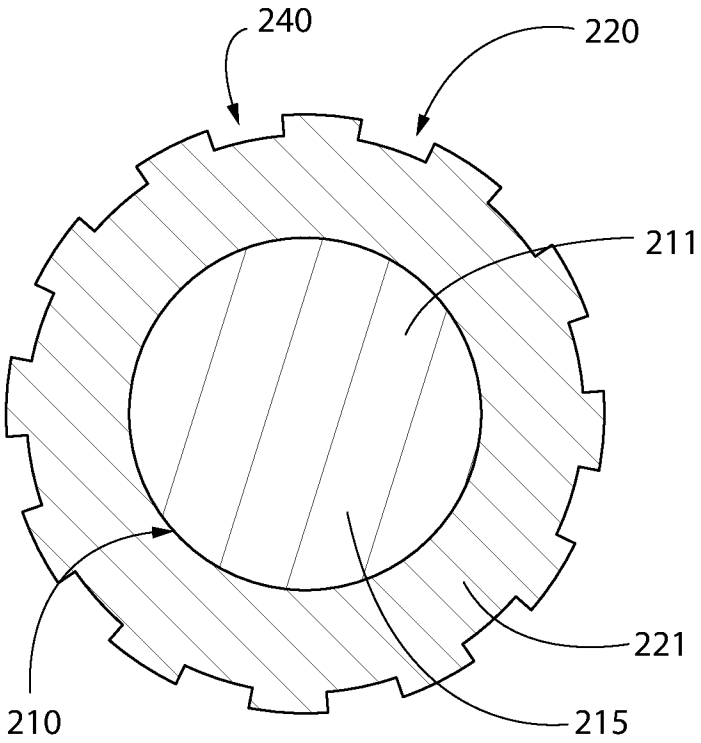
FIG. 9A is a cross sectional view taken along line IXA-IXA in FIG. 4.

In the exemplified embodiment, the upper portion 216 of the core component 210 makes up between approximately 15-20% of the total length of the multi-component bristle 200 (measured from base end 201 to free end 202), more specifically between approximately 17-23% of the total length of the multi-component bristle 200, and even more specifically between approximately 20-22% of the total length of the multi-component bristle 200. In another embodiment, the exposed upper portion 216 of the core component 210 may make up between approximately 10-15%, and more specifically between approximately 12-13% of the total length of the multi-component bristle 200. Furthermore, the sheath component 220 extends approximately 75-80% of the total length of the multi-component bristle 200, more specifically approximately 77-83% of the total length of the multi-component bristle 200, and even more specifically between approximately 78-80% of the total length of the multi-component bristle 200, or between approximately 85-90% or 87-88% of the total length of the multi-component bristle 200. Other variations in the length of the core component 210 and sheath component 220 are possible which does not limit the invention In the exemplified embodiment, the multi-component bristle 200 has a circular cross-sectional shape as best shown in FIGS. 9A-9B. Furthermore, the core component 210 has a solid circular cross-sectional shape and structure, and the sheath component 220 has a an annular ring-like shape and structure that circumferentially and concentrically surrounds the core component 210 for at least part of the length of the core component 210. Of course, the invention is not so limited and the core component 210 can take on other polygonal and non-polygonal (e.g. oblong, ovoid, etc.) cross-sectional shapes as desired and the shape of the sheath component 220 can likewise have a corresponding and complementary cross-sectional shape preferably so long as the sheath component 220 circumferentially surrounds the core component 210 for at least a portion of the length of the core component 210.

With continuing reference to FIGS. 2-9B inclusive, the multi-component bristle 200 may be a coextruded monofilament. In one embodiment, the core component 210 is formed of the first material 211 and the sheath component 220 is formed of the second material 221. In certain embodiments, each of the first and second materials may be the same. In such embodiments, both of the first and second materials 211, 221 may each be erodible by a chemical etchant for tapering the multi-component bristle, or alternatively neither of the first and second materials 211, 221 may be erodible by the etchant. In other possible embodiments, the first and second materials 211, 221 may be different. In one particular embodiment, the first material 211 may be erodible by an etchant and the second material 221 may be chemically resistant to the etchant. Furthermore, in one non-limiting embodiment the first material 211 is a polyester, such as polybutylene terephthalate (PBT), and the second material 221 is a polyamide, such as nylon. Of course, the invention is not to be limited by the particular materials that are used to form the core and sheath components 210, 220 unless so specified in the claims. Accordingly, other chemically etchable and non-etchable materials may be used to fabricate the core and sheath components 210, 220 of the multi-component bristles 200.

The first and second materials 211, 221 of the multi-component monofilament bristle 200 of course may be formed from a wide variety of other synthetic materials which may be coextruded. Examples of materials that may be used to form the monofilament bristle 211 include, but are not limited to aramid, and other polyamide resins, polypropylene terephthalate (polytrimethylene terephthalate, PPT or PTT), or polyethylene terephthalate (PET), and other polyester resins, polypropylene (PP), polyethylene (PE) and other polyolefin resins, and other synthetic resins can be used for the bristles.

Referring to FIGS. 2, 4-5, and 8A-B, in one non-limiting embodiments portions of both the core and sheath components 210, 220 of the multi-component bristle 200 may be tapered on distal portions of the bristle from the toothbrush head 110. Accordingly, the sheath component 220 may have a tapered section 224 and the core component 210 may also have a tapered section 214. The tapers on sections 214 and 224 may match or be different. In one implementation, the entire length of sheath component 220 including tapered section 224 may have a substantially constant inner diameter D1 whereas the wall thickness T1 at transition point TP1 gradually reduces in the tapered section 224 starting at a transition point TP1 and moving upwards towards the terminal end 203 of the sheath component. This creates a frustoconical shape in the tapered section 224 of sheath component 220. Thus, in the exemplified embodiment, the transition point TP1 is the point on the multi-component bristle where the sheath component 220 begins to taper and angle inwards towards longitudinal axis A-A. Portions of the sheath component 220 below the transition point TP1 may have lateral outer surfaces that are substantially parallel to each other as shown, whereas the lateral outside surfaces are non-parallel and converging moving upwards from transition point TP1.

A tip portion 230 of the multi-component bristle 200 is formed by tapered section 224 of sheath component 220 and exposed tapered section 214 of core component 210. The tip portion 230 may have a conical shape that gradually decreases in transverse cross-sectional area starting at transition point TP1 and moving upwards towards the free end 202 of the multi-component bristle. The tapered section 224 of sheath component 220 gradually decreases in annular transverse cross-sectional area and outer diameter D3 starting at transition point TP1 and moving upwards towards the terminal end 203 of the sheath component. The core component 210 may begin to taper starting at or proximate to the top terminal end 203 of the sheath component 220 and moving upwards towards bristle free end 202 and core component tip 214*a* as illustrated (see, e.g. FIGS. 2, 4-5, and 8A-B). In certain embodiments where chemical etching is used to form the tapered section 214 of the core component 210, the core component cannot be tapered between the terminal end 203 of the sheath component 220 and the base end 201 of the multi-component bristle 200 because the core component 210 covers and shields the first lower portion 215 of the core component covered by the sheath component 220 in that portion from being etched. Thus, in particular when chemical etching is used to taper the multi-component bristle 200, only the exposed upper portion 216 of the core component 210 immersed in the etching solution chemical bath will be tapered to form the tapered section 214 of the bristle. Accordingly, the lower portion 215 of the core component 210 has a substantially constant outer diameter D2 whereas the exposed upper portion 216 and tapered section 214 has a gradually reducing outer diameter D2 terminating in a relatively sharply pointed tip 214*a* in one embodiment. In other embodiments the tip 214*a* may more or less be slightly rounded such as without limitation by grinding or other mechanism methods after immersing the tip portion 230 of the multi-component bristle 200 in the etching solution. The use of etching solutions and baths and their chemical compositions for dissolving and tapering certain material bristles is known in the art. Any suitable etching solution operable to dissolve the type of material used to fabricate the bristle components may be used.

In the exemplified embodiment, the taper of tip portion 230 may be continuous from the transition point TP1 to the free end 202 of the multi-component bristle 200 defined by core component 210. Thus, the reduction in cross-sectional area from the transition point TP1 to the free end 202 is continuous, which results in a substantially smooth transition between the sheath component 220 and the core component 210. Accordingly, there are no substantial bumps, ridges, edges, peaks, or grooves at transition point TP1 between the core and sheath components 210, 220, but rather simply a smooth transition. The transverse cross-sectional area and outer diameter D3 of the sheath component 220 at the terminal end 203 of the sheath component 220 and below is substantially identical to the cross-sectional area and corresponding outer diameter D2 of the core component 210 at the terminal end 203 of the sheath component 220. Furthermore, the transverse cross-sectional area and outer diameter D3 of the sheath component 220 at the terminal end 203 of the sheath component 220 is less than the transverse cross-sectional area and outer diameter D3 of the sheath component 220 below the terminal end 203 and at the transition point TP1 and below. Due to the core component 210 beginning to taper at the terminal end 203 of the sheath component 220, the tip portion 230 of the multi-component bristle 200 has a substantially continuous, uninterrupted taper despite being formed partially by the sheath component 220 and partially by the core component 210.

In the exemplified embodiment, the tapered tip portion 230 of the multi-component bristle 200 is formed by the tapered section 214 of the core component 210 and the tapered section 224 of the sheath component 220. In the exemplified embodiment, the core component 210 forms a majority and substantially larger part of the tip portion 230 of the multi-component bristle 200 than the sheath component 220. Specifically, in the exemplified embodiment the tapered section 214 of the core component 210 has a greater length than the tapered section 224 of the sheath component 220 (measured vertically along bristle axis B-B). However, the invention is not limited to this arrangement in all embodiments, and in certain other embodiments the core and sheath components 210, 220 can each form substantially the same amount (i.e., percentage of the length) of the tip portion 230, or the sheath component 210, 220 can form a greater part of the tip portion 230 of the multi-component bristle 200 than the core component 210.

In the exemplified embodiment, each of the first and second 211, 221 materials may be formed of a polyester so as to be erodible by an etchant such that the conical shape of the tip portion 230 of the multi-component bristle 200 is formed by chemical etching. Thus, if the tip portion 230 of multi-component bristle 200 is dipped into an etchant solution from the free end 202 to the transition point TP1 and slowly removed therefrom, the multi-component bristle 200 material will partially dissolve and form a taper from the transition point TP1 to the free end 202, and more specifically the sheath component 220 will taper from the transition point TP1 to the terminal end 203 of the sheath component 220 and the core component 210 will taper from the terminal end 203 of the sheath component 220 to the free end 202 of the multi-component bristle 200. In the exemplified embodiment, the core component 210 has a constant transverse cross-sectional area from the base end 201 of the multi-component bristle 200 to the terminal end 203 of the sheath component 220 and the sheath component 220 has a constant transverse cross-sectional area from the base end 201 of the multi-component bristle 200 to the transition point TP1. Of course, other configurations are possible, such as varying transverse cross-sectional areas of each of the core and sheath components 220, 320 along the length of the multi-component bristle 200.

Of course, formation of the tapered conical tip portion 230 of the multi-component bristle 200 is not limited in all embodiments to a chemical etching process and in certain other embodiments the conical shape of the tip portion 230 can be formed by mechanical grinding or any other means. Regardless of the manner of creating the taper/conical shape, in the exemplified embodiment each of the core and sheath components 210, 220 comprise a tapered portion 214, 224 that collectively form the conical shape of the tip portion 230 of the multi-component bristle 200. Furthermore, in the exemplified embodiment, the free end 202 of the multi-component bristle 200 is tapered to a relatively sharp point or tip 202. Of course, the invention is not to be so limited in all embodiments and in certain other embodiments only the core component 210 may be tapered while the sheath component 220 is not tapered or only the sheath component 220 may be tapered while the core component 210 is not tapered. Furthermore, in still other embodiments the multi-component bristle 200 may be tapered, but still have a slightly rounded free tip end.

According to one embodiment, the core and sheath components 210, 220 of the multi-component bristle 200 may be formed by a material co-extrusion process. The multi-component bristle 200 however may be formed and coupled by other suitable methods such as mechanical coupling, adhesives, ultrasonic welding, etc. Accordingly, the invention is not limited by the method used to fabricate the multi-component bristles.

Referring now to FIGS. 2-4, 6, 8A, and 9A, a multi-component bristle 200 is shown according to one construction of the present invention. This embodiment is configured and particularly useful for cleaning of the interdental regions between teeth which harbor debris and bacteria that may cause oral cavity related diseases of the teeth and gums. The tapered section 214 on the upper portion 216 of the core component 210 has a smooth untextured outer surface 217 whereas by contrast the adjoining sheath component 220 has a rougher undulating and textured outer surface 218 creating a surface profile comprising irregularities that create a greater surface roughness than the core component. The smoother leading outer surface 217 of the tapered core component 210 provides smoother gliding action for enhanced insertion in between the teeth whereas the larger diameter trailing rougher trailing outer surface 218 of the sheath component 220 which follows provides enhanced polishing and stain removal action on the teeth. It bears noting that the tapered section 224 of the sheath component 220 improves insertion and penetration in between the teeth in the interdental regions. The textured outer surface 218 of the sheath component increases the roughness and hence coefficient of friction (COF) of the surface creating better abrasive action when contacting surfaces of the teeth to achieve the foregoing improved polishing and stain removal characteristics. Accordingly, in the present embodiment the exposed outer surface 218 of the sheath component 220 has a greater surface roughness and higher COF than outer surface 217 of the core component 210. Presented another way, the outer surface 218 of sheath component 220 has greater degree or amount of measureable surface irregularities or discontinuities than the outer surface 217 of the core component 210. In certain embodiments, the degree of surface roughness may be characterized by rugosity which is a measure of small-scale variations or amplitude in the height of a surface. In other embodiments, surface roughness which is a quantifiable parameter may be determined by established test and measurement standards such ISO 4287 or other applicable standards using commercially available surface roughness testers employed in surface metrology. The testers allow determination of various surface roughness parameters, such as without limitation Ra which is the arithmetic average of the roughness profile, Pa which is the arithmetic average of the unfiltered raw profile, and Sa which is the arithmetic average of the 3D roughness.

The textured and roughened outer surface 218 of sheath component 220 may have a surface profile contoured by any number and type of raised and/or recessed surface friction-enhancing features 240. This includes for example without limitation a plurality of regular or irregular shaped recesses (see, e.g. FIG. 3A), protuberances (see, e.g. FIG. 3B), valleys, ridges/peaks, surface porosity comprised of open pores, polygonal and non-polygonal geometric-shaped protuberances or recesses, and other structures configured to provide an undulating and irregular surface profile that increases frictional resistance when placed in sliding contact with the surfaces of the teeth. The friction-enhancing features 240 may be arranged in uniform or irregular/random patterns and have any suitable dimensions. In the non-limiting illustrated embodiments in FIGS. 3A and 3B, as some of many possible configurations, the friction-enhancing features 240 are in the form of ellipsoidal recesses or alternatively may be protrusions or protuberances of the same shape as an example of one many possible surface irregularities that might be used. The invention is expressly not limited to any particular shape, pattern, dimensions, or type of friction-enhancing features 240 unless specifically limited by the language of the claims.

The friction-enhancing features 240 on the surface of multi-component bristle 200 may be created by any suitable formative process now known or to be developed and is expressly not limiting of the invention. In certain exemplary embodiments, the friction-enhancing features 240 may be formed by erosive chemical action on the exposed bristle surface which configure the outer surface 218 of the sheath component 220 (e.g. acidic solutions, etc.) and are operable to roughen or mottle the exposed surface. In other exemplary embodiments, the friction-enhancing features 240 may be formed by abrasive mechanical action on the exposed bristle surface such as via the use of sandpaper, grinding wheels, or similar abrasive tools operable to roughen or mottle the surface. In yet other exemplary embodiments, the friction-enhancing features 240 may be formed by non-abrasive mechanical action such as via embossing, stamping, etc. on the exposed bristle surface. In additional exemplary embodiments, the friction-enhancing features 240 may be formed by molding. In other exemplary embodiments, the friction-enhancing features 240 may be formed by the material structure itself of the sheath component 220 such as by using a porous material that can be created by injecting a gas into the bristle mold when the polymeric material is in a heated and flowable state during the injection molding or casting process. This will create a porous structure throughout the material in which open pores disposed at and penetrating the outer surface 218 of the sheath component 220 will form a randomly pore riddled surface structure. The size of the pores can be varied to produce either a coarser or finer surface finish for controlling the degree of abrasive action on the teeth (i.e. smaller pores produce finer finish with less aggressive abrasion and larger pores produce coarser finish with more aggressive abrasion). This concomitantly provides either more or less polishing action on the teeth depending on whether a coarser or finer surface finish is created, respectively.

Variations and combinations of the foregoing methods and approaches to creating the friction-enhancing features 240 on the surface of multi-component bristle 200 may be used. The method(s) selected will be based in part by the desired type and pattern of friction-enhancing features 240 to be created.

In certain embodiments, the entire exposed outer surface 217 of the core component 210 may be textured and have surface irregularities or discontinuities (i.e. friction-enhancing features 240), or only a portion of the surface may have surface irregularities or discontinuities. In certain embodiments, the entire exposed outer surface 218 of sheath component 220 may be textured and have surface irregularities or discontinuities (i.e. friction-enhancing features 240), or only a portion of the surface may have surface irregularities or discontinuities. In preferred but non-limiting embodiments, the entire exposed outer surface of the core component 210 or sheath component 220 has surface irregularities or discontinuities.

Referring now to FIGS. 5, 7, 8B, and 9B, an alternative embodiment of a multi-component bristle 200 is illustrated that is opposite in construction to the multi-component bristle described above and shown in FIGS. FIGS. 2-4, 6, 8A, and 9A. In this implementation, the tapered exposed upper portion 216 of the core component 210 instead has a textured outer surface 217 comprising surface irregularities or discontinuities creating a greater surface roughness than the core component 220 which by contrast has a smooth untextured outer surface 218 creating lesser surface roughness than the core component. The rougher leading outer surface 217 of the tapered core component 210 provides enhanced polishing and stain removal action on the teeth whereas the larger diameter trailing smooth outer surface 218 of the sheath component 220 which follows provides smoother gliding action and deeper penetration in between the teeth. Accordingly, in the present embodiment the exposed outer surface 217 of the core component 210 has a higher coefficient of friction than outer surface 218 of the sheath component 220.

In certain embodiments, the core component 210 and/or sheath component 220 may contain particulate additives 241 to create friction-enhancing features 240 and control the corresponding surface roughness and coefficient of friction, thereby providing a textured roughened finish to outer surfaces 217 and 218. The additives enhance the abrasive characteristics of these surfaces. Any type of particulate additives or grains may be used for this purpose having a size and configuration suitable for creating an abrasive action on the teeth. Suitable materials include pumice and others. The size and configuration of the particulate additives will be determinative of the degree of surface roughness created and allow control of the level of abrasive action on the teeth.

In one configuration illustrated in FIGS. 5, 6, 8B, and 9B, the core component 210 includes particulate additives forming a textured roughened outer surface 217 and the sheath component 220 is devoid or free of such particles having a smooth outer surface 218 in contrast to the core component. The particulate additives may be embedded throughout the material and interior of the core component 210 in certain implementations, and in other implementations the particulate additives may only be disposed on the exposed outer surface 217 of the core component. In an opposite construction, the sheath component 220 may instead include particulate additives forming a textured outer surface 218 and the core component 210 is devoid or free of such particles having a smooth outer surface 217. In yet other embodiments, both the core component 210 and sheath component 220 may include particulate additives.

Figure 8A:
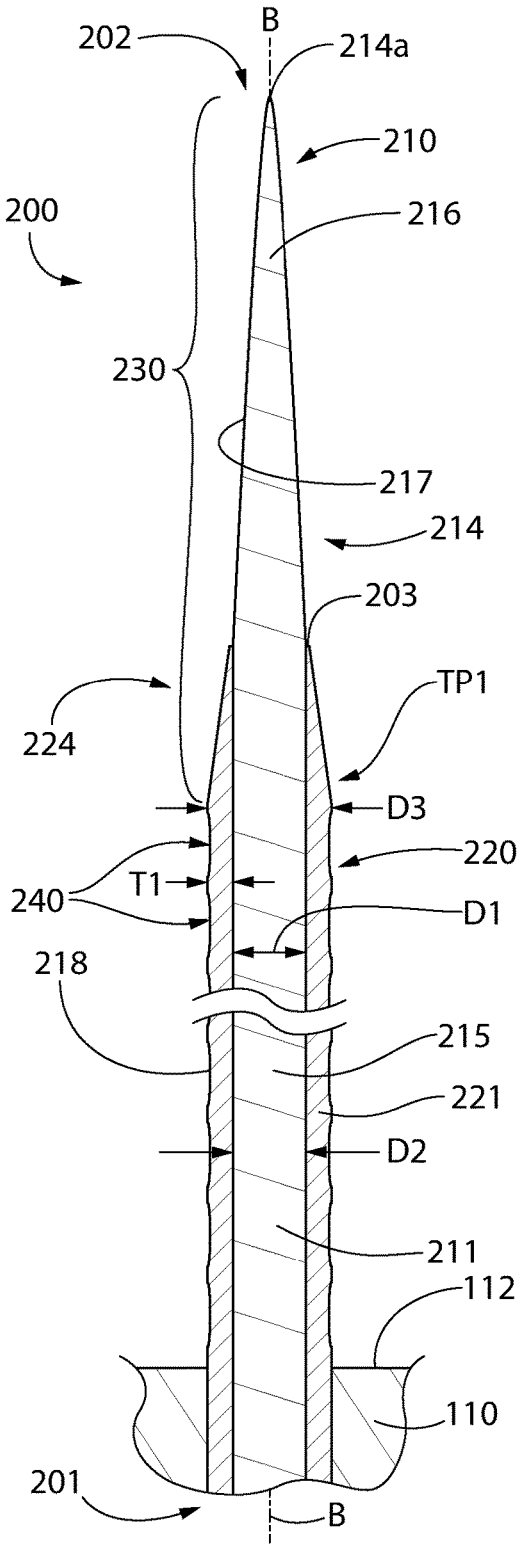
FIG. 8A is a longitudinal cross-sectional view of a multi-component bristle of FIG. 2.
Figure 8B:
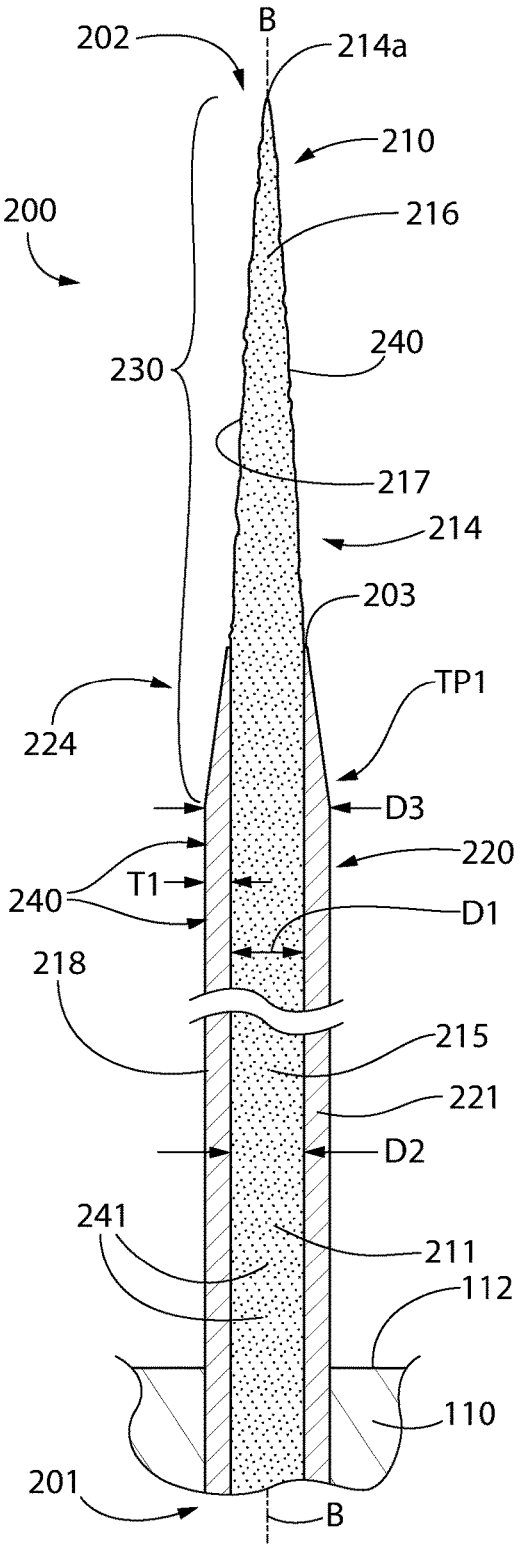
FIG. 8B is a longitudinal cross-sectional view of the alternative construction of FIG. 5.

Referring to FIGS. 8A and 8B, in certain embodiments forming the core component 210 with an abrasive outer surface 217 may be created by melting the first material 211 such as via heating and dispersing particulate additives throughout the melted first material 211. The particulate additives are thereby mixed into the first material 211 preferably homogeneously to uniformly disperse the particles throughout the material. Some of the particulate additives will therefore be exposed on the outer surface 217 of the core component for cleansing, polishing, and stain removal action on the surfaces of the teeth. Likewise, in some embodiments, particulate additives may be similarly dispersed in the second material of the sheath component 220 in a similar fashion forming an abrasive outer surface 218. Some of the particulate additives will therefore be exposed on the outer surface 218 of the sheath component. In various embodiments, only one of the core and sheath components 210, 220 may contain particulate additives (see, e.g. FIG. 4 or 5), or both the core and sheath component may contains particulate additives (not specifically shown herein but achievable by combining the textured components of FIGS. 4 and 5). In some embodiments, the particulate additives in the core and sheath components 210, 220 may be the same or may be different types and/or sizes to vary and adjust the frictional tooth cleansing performance.

Upon cooling after incorporating the particulate additives, the first and second melted materials will become hardened. Next, in certain embodiments the first and second materials 211, 221 can be coextruded to form the multi-component bristle 200 from the core and sheath components 210, 220. Alternatively, the first material with particulate additives therein can be formed into the core component 210 and the second material with particulate additives therein can be formed in a separate process into the sheath component 220 (either by separate extrusion processes or any other bristle strand forming process now known or later developed). Subsequently, the core and sheath components 210, 220 can then be mechanically coupled together to form the multi-component bristle 200 via any suitable process. In either case, the multi-component bristle 200 is formed from the core and sheath components 210, 220, each of which or only one of which may contain particulate additives. Subsequent to either of the foregoing formative bristle processes, the multi-component bristle 200 may then be dipped into the etchant solution to form the conical taper of the core component 210.

In certain embodiments, the conical tip portion 230 of multi-component bristle 200 may be formed by briefly immersing an end of the in a bath of a chemical etchant solution, such as a caustic soda (NaOH). When the end is removed from the bath, the conical tip portion 230 is formed. The length of the tip portion may be adjusted by the concentration of the chemical solution, immersing time, and pulling out speed from the chemical solutions, among other factors. The tip portion 230 may generally be delineated from the body of the bristle 200 in that the tip portion is the portion of the bristle 200 that is immersed in the chemical etchant solution In some embodiments, particulate additives may be applied only to the outer surface 217 of the core component 210 and/or the outer surface 218 of sheath component 220 instead of being dispersed throughout the material matrix of each material. Accordingly, the invention is not limited to either construction or arrangement of particulate additives.

Figure 10A:
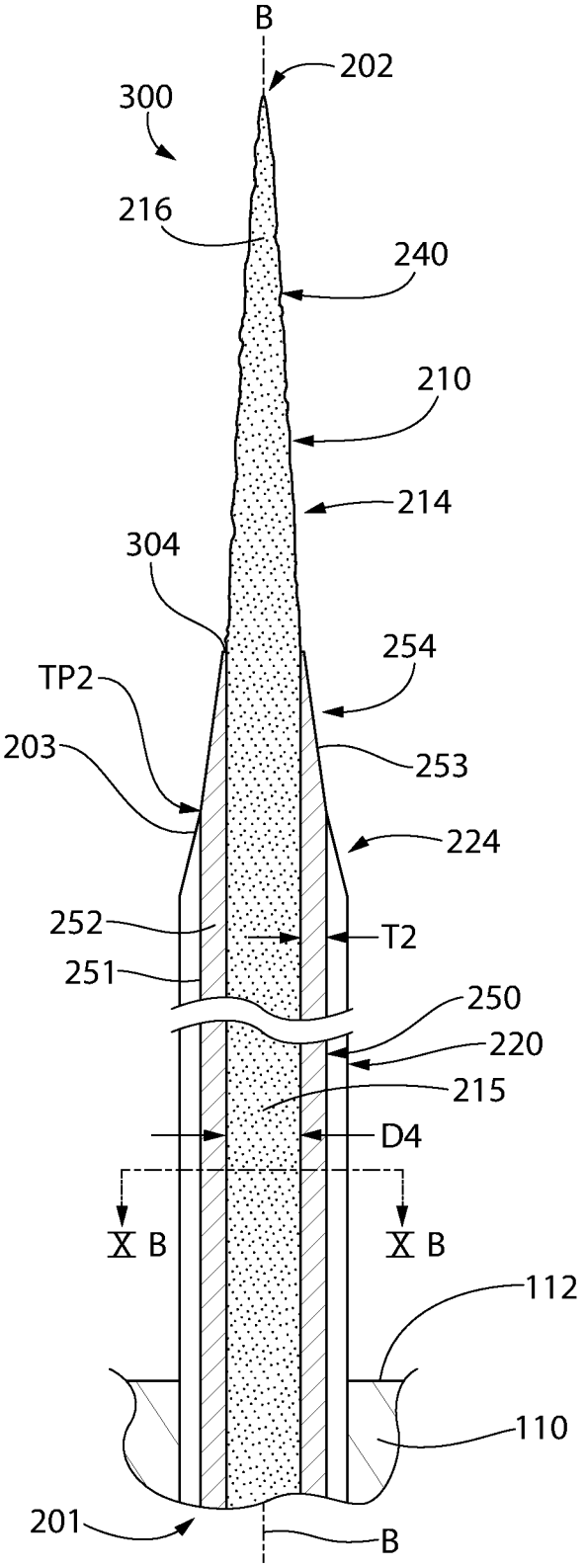
FIG. 10A is longitudinal cross-sectional view of a three-component embodiment of a multi-component bristle according to the present disclosure.
Figure 10B:
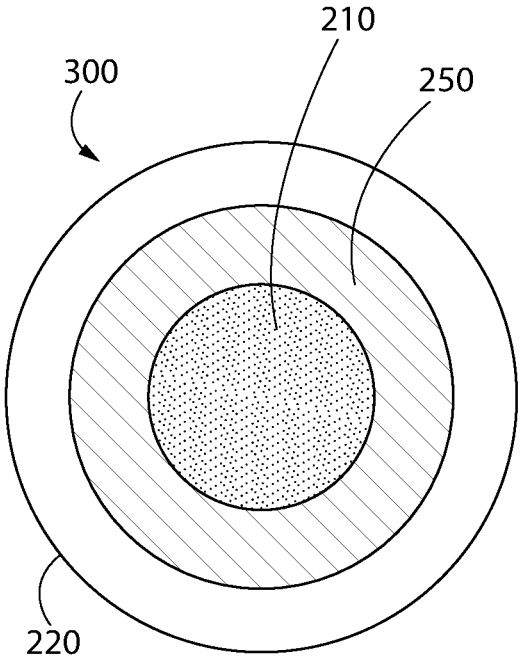
FIG. 10B is a cross-sectional view taken along line XA-XA in FIG. 10A.

Referring now to FIGS. 10A and 10B, a multi-component bristle 300 is illustrated in accordance with another alternative construction of the present invention. The multi-component bristle 300 extends from base end 201 to a free end 202 along bristle axis B-B. The multi-component bristle 300 comprises inner core component 210, outer sheath component 220, and an intermediary component 250 interspersed between core and sheath components. The core component 210 and sheath component 220 may be essentially the same as that already described herein, with the addition of the intermediate component 250 differentiating multi-component bristle 300 from multi-component bristle 200. Multi-component bristle 300 may be similarly formed by coextrusion of the components 210, 220, and 250, or other suitable formative processes.

The intermediary component 250 has a cylindrical tubular structure with a top terminal end 304 located between the terminal end 203 of sheath component 220 and free end 202 of multi-component bristle 300. The sheath component 220 surrounds a first lower portion 252 of the intermediary component 250. A second upper portion 253 of the intermediary component 250 protrudes axially outwards from the sheath component 220 beyond terminal end 203 and is exposed. The intermediary component 250 surrounds the first lower portion 215 of the core component 410. The second upper portion 216 of the core component 210 protrudes axially outwards from the terminal end 304 of the intermediary component 430.

The intermediary component 250 may include a tapered section 254 forming a continuous and complementary-angled taper with at least the tapered section 224 of the sheath component 220 forming a smooth transition to the core component 210. Tapered section 254 is formed on the exposed upper portion 253 of the intermediary component 250. When the multi-component bristle 300 is tapered in the manner already disclosed herein, the outer surface 251 of the intermediary component 250 is exposed in the tapered section 254. The tapered section 254 of intermediate component 250 therefore protrudes upwards and outwards from the top terminal end 203 of the sheath component 220 whereas the remainder of the intermediary component 250 is enclosed by the sheath component 220 for the rest of its length as shown.

In some embodiments, the intermediary component 250 may have a textured exposed outer surface 251 with friction-enhancing features 240 whose structure and formation has already been described herein. In other embodiments, the exposed outer surface 251 may be smooth and plain without friction-enhancing features 240. The core component 210 and sheath component 220 may be textured or smooth/plain.

The intermediate component 250 is formed of a third material 251, which may be the same as or different than one of or both of the first and second materials 211 and 221 of the sheath component 220 and core component 210 respectively. Accordingly, in some embodiments all three bristle components may be made of the same or different materials. Accordingly, in certain embodiments, each of the first, second and third materials 211, 221, 251 can be the same, and in other embodiments each of the first, second and third materials can be different, and in still other embodiments two of the first, second and third materials can be the same while the other of the first, second and third materials is different. All of the disclosure with regard to tapering, shape, materials, and formation discussed above with regard to the multi-component bristle 200 is equally applicable to the multi-component bristle 300.

In one implementation, the tapered section 254 of the intermediary component 250 may have a substantially constant inner diameter D4 and a wall thickness T2 which gradually reduces in the tapered section 254 starting at a transition point TP2 and moving upwards towards the free end 202 of the multi-component bristle 300. This creates a frustoconical shape in the tapered section 254 of intermediary component 250. Thus, in the exemplified embodiment, the transition point TP2 is the point on the multi-component bristle where the intermediary component 250 begins to taper. The length measured along bristle axis B-B of the exposed tapered section 214 of the core component 220 is larger than the length of the tapered section 254 of intermediary component 250 and tapered section 224 of sheath component 220.

Furthermore, although the invention has been described herein with regard to an oral care implement 100 having at least one bristle tuft 116 including at least one multi-component bristle 200 or 300, in certain embodiments the inventive concept described herein is the multi-component bristle itself.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A monofilament bristle comprising:

coextruded core and sheath components;

the sheath component having an outer surface and surrounding a first portion of the core component;

a second portion of the core component protruding from the sheath component and forming an exposed tip portion;

the sheath component comprising a first material; and the core component comprising a second material;

wherein the exposed tip portion of the core component has an outer surface including friction-enhancing features;

wherein the first and second materials are the same; and wherein the first and second materials are free of an abrasive.

2. The monofilament bristle according to claim 1 wherein the exposed tip portion has a conical shape that decreases in transverse cross-sectional area moving toward a free end of the monofilament bristle.

3. The monofilament bristle according to claim 1 wherein the sheath component has a substantially constant diameter from a bottom base end of the sheath component to a top terminal end of the sheath component.

4. The monofilament bristle according to claim 1 wherein the friction-enhancing features of the core component are formed by particulate additives dispersed in the first material of the core component.

5. The monofilament bristle according to claim 1 wherein the sheath component has an outer surface having a lower rugosity than the exposed tip portion of the core component.

6. The monofilament bristle according to claim 1 wherein the outer surface of the core component has a higher coefficient of friction than the outer surface of the sheath component.

7. The monofilament bristle according to claim 1 wherein the friction-enhancing features comprise protuberances protruding outwards from the outer surface of the core component.

8. The monofilament bristle according to claim 1 wherein the friction-enhancing features comprise recesses formed into the outer surface of the core component.

9. The monofilament bristle according to claim 1 wherein the outer surfaces of the core and sheath components each includes friction-enhancing features.

10. An oral care implement comprising a handle, a head coupled to the handle, and a monofilament bristle according to claim 1 coupled to the head.

11. A monofilament bristle comprising:

coextruded core and sheath components;

the sheath component having an outer surface and surrounding a first portion of the core component;

a second portion of the core component protruding from a top terminal end of the sheath component to form an exposed tip portion;

the sheath component comprising a first material;

the core component comprising a second material;

wherein the exposed tip portion of the core component is tapered and has an outer surface with a first roughness and the outer surface of the sheath component has a second roughness, the second roughness being greater than the first roughness.

12. The monofilament bristle according to claim 11 wherein the exposed tip portion has a conical shape that decreases in transverse cross-sectional area moving toward a free end of the monofilament bristle.

13. The monofilament bristle according to claim 11 wherein the sheath component has a substantially constant inner diameter from a bottom base end of the sheath component to a top terminal end of the sheath component.

14. The monofilament bristle according to claim 13 wherein the sheath component surrounding the first portion of the core component has a constant wall thickness that is interrupted by voids or protrusions.

15. The monofilament bristle according to claim 11 wherein the first roughness of the core component is formed by particulate additives dispersed in the first material of the core component.

16. A monofilament bristle comprising:

coextruded core and sheath components; and the sheath component having an outer surface and surrounding a first portion of the core component, the core component further having a second portion protruding from a top terminal end of the sheath component to form an exposed conical tip portion;

wherein the conical tip portion of the core component has an outer surface configured to have higher coefficient of friction than the outer surface of the sheath component;

wherein the higher coefficient of friction of the core component is created by one of open pores disposed on the outer surface of the core component or protuberances protruding outwards from the outer surface of the core component; and wherein the core and sheath components are free of an abrasive material.

17. The monofilament bristle according to claim 11 wherein the core and the sheath component are free of an abrasive material.

* * * * *